United States Patent [19]

Gerkey

[11] 4,178,787

[45] Dec. 18, 1979

[54] REMOTELY OPERATED TUBE EXPANDING TOOL AND SUPPORT

[75] Inventor: Kenneth S. Gerkey, Mt. Lebanon, Pa.

[73] Assignee: Westinghouse Electric Corp., Pittsburgh, Pa.

[21] Appl. No.: 932,583

[22] Filed: Aug. 10, 1978

[51] Int. Cl.[2] ..... B21D 39/06

[52] U.S. Cl. ..... 72/122; 72/125; 29/727

[58] Field of Search ..... 72/112, 122, 125; 29/726, 727

[56] References Cited

U.S. PATENT DOCUMENTS

| | | | |
|---|---|---|---|
| 629,354 | 7/1899 | Hampson | 72/115 |
| 683,274 | 9/1901 | Hampson | 29/727 |
| 736,684 | 8/1903 | Cain | 29/727 |
| 766,713 | 8/1904 | Loetzer | 72/112 |
| 2,013,933 | 9/1935 | Wagner | 29/726 |
| 3,585,701 | 6/1971 | Stary | 29/727 |

*Primary Examiner*—Lowell A. Larson
*Attorney, Agent, or Firm*—F. A. Winans

[57] ABSTRACT

A remotely operated tool and tool support for positioning heat exchanger tube ends within a tube sheet of a steam generator and expanding the tube end into intimate contact with the tube sheet. The tool includes a tool head for insertion into the vertically extending tubes and a drive means which is supported horizontally by the tool support. The tool head is supported for vertical movement with respect to the drive means and right angle gear means are interposed therebetween in a vertically movable mount to permit such relative movement. Switch means responsive to the relative positions of the tool head, drive means, and right angle gear means indicate each is in a proper position to initiate or terminate the operation of the tool.

5 Claims, 6 Drawing Figures

REMOTELY OPERATED TUBE EXPANDING TOOL AND SUPPORT

BACKGROUND OF THE INVENTION

Field of the Invention

This invention relates to a tack roll tool for expanding the ends of heat exchanger tubes into intimate contact with openings through a tube sheet of a steam generator and more particularly to such a tool and tool support therefor for remote automatic operation within a nuclear steam generator.

2. Description of the Prior Art

Retubing of a steam generator generally includes a procedure for initially placing the heat exchanger tube ends flush with the lower face of a tube sheet and manually tack rolling the tube end (e.g. expanding the diameter of the tube wall by an internal tube expansion tool) so as to provide intimate contact to retain the tube in proper position in the tube sheet for subsequent welding therebetween.

In a normal steam generator such operation can be done manually and the tack roll tool generally comprises a pistol-like hand-held reversible air motor having a tool chuck for receiving the expanding-roller tool head which in turn comprises an axially extending, rotatable, conically tapered mandrel and a plurality of generally cylindrical roller members mounted in slantwise relationship thereon by a mandrel cage so that rotation of the mandrel causes the rollers to roll against the tube wall and, as the wall diameter expands, the increasing diameter of the tapered mandrel causes the rollers to move further radially outwardly to continue the expansion procedure. In such manual tool, the collar of the tool chuck has a flat face for engaging the tube end extending below the lower face of the tube sheet, and the tool is disposed within the tube. The tube and tool are thus manually lifted until the chuck face contacts the bottom face of the tube sheet. Further upward movement of the air motor pistol grip (while the chuck and tool remain stationary) permits air valving internal to the air motor to initiate forward rotation of the tool head to accomplish the tack rolling. As the tube is expanded into engagement with the tube sheet the torque required by motor is increased. Upon a preset torque being attained, the tool head stops automatically and a manually operated reversing trigger is depressed to reverse the air motor to free the tool from the expanded tube and ready for the next expansion process. Such an air driven tube expansion torque control tool is commercially available from the Tool Group Marketing Division of Dresser Industries Inc. and identified as Airetool Model 810, in *Airetool Tube Expander Catalog* #E-3-10.

However, in the environment of an irradiated nuclear steam generator the manual procedure described above must be accomplished by a remotely operated tool in order that presence of repair personnel within the generator is minimized. Further, because of certain internal structure of the nuclear steam generator and because of the desirability for unimpeded maneuverability of the tool, the pistol-like air motor and tool chuck cannot be maintained together in axial vertical alignment without causing interference with certain other structure of either the generator or the tool support.

SUMMARY OF THE INVENTION

The present invention provides a tube expansion tool and tool support wherein the expansion head is supported in a vertical position for insertion into the vertically oriented heat exchanger tubes, and the reversible drive motor is supported horizontally to minimize the overall vertical dimension of the tool. A right angle gear drive mechanism is interposed between the expansion head and the drive motor with the gear mechanism mounted in a housing permitting vertical movement as the rotationally driven tapered expanding mandrel advances vertically upwardly into the tube. The drive motor is mounted for horizontal movement to actuate the drive motor through depression of the nose (i.e. collet) thereof which causes forward rotation of the motor when air is supplied to the forward air inlet. The tool support arm is mounted on a rotatable plate at the end of a movable boom of apparatus temporarily installed within the channel head of a nuclear steam generator for detubing and retubing operations. To permit 360° rotation of the tool and tool support in a horizontal plane on the rotatable plate, all elements of the tool and support are positioned above the horizontal plane of the boom.

DESCRIPTION OF THE PREFERRED EMBODIMENT

Figure 1:
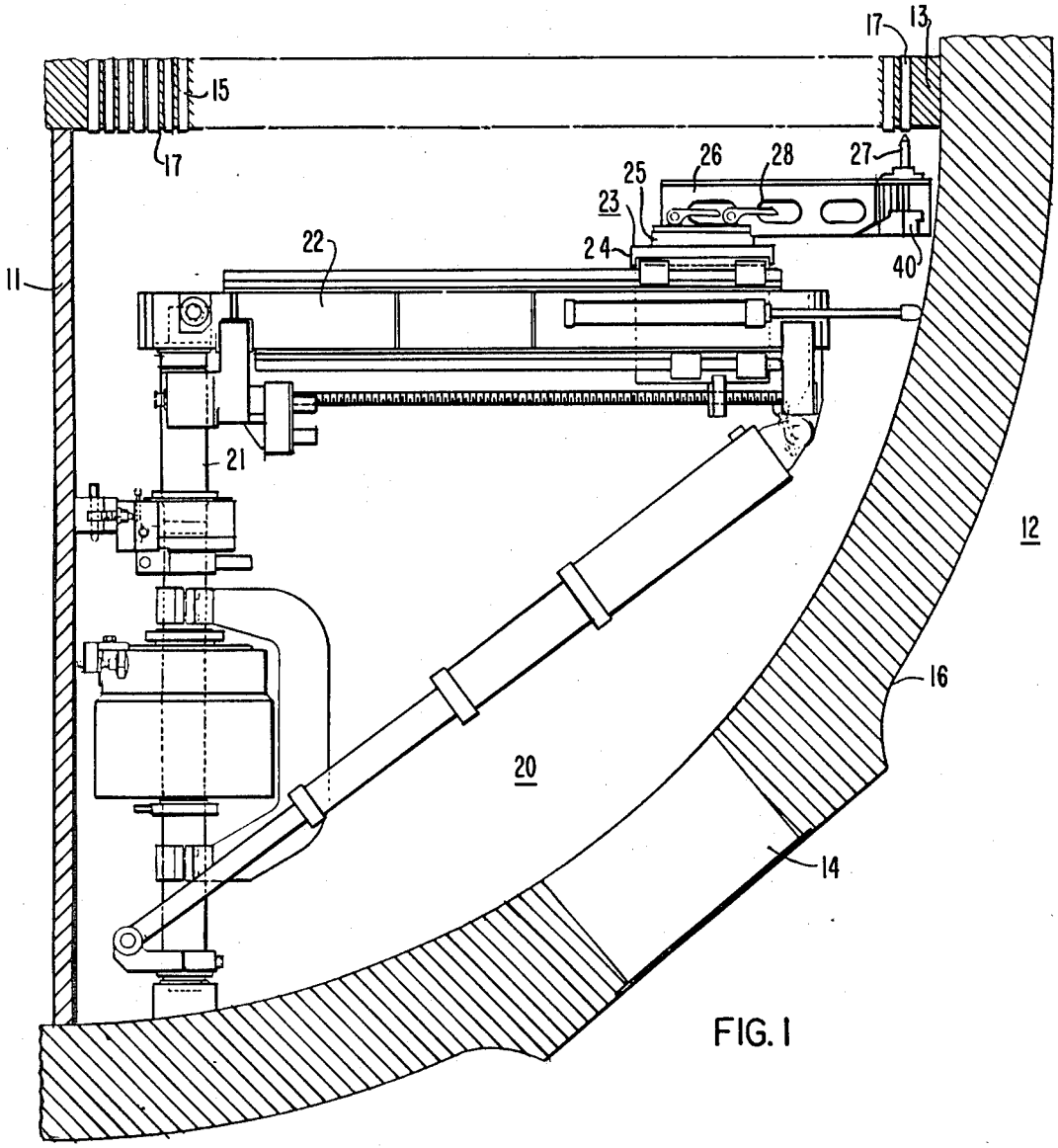
FIG. 1 is a partial sectional view of a steam generator head with remotely operated apparatus disposed therein for repairing and replacing the heat exchanger tubes.

It is to be understood that the tube positioning and tack rolling tool and tool support therefor according to the present invention are particularly adapted to be mounted upon apparatus temporarily disposed within the channel head of a nuclear steam generator for remote operation of the tool to retube and refurbish the steam generator. Such remotely operated apparatus is particularly described in commonly owned copending patent applications Ser. No. 888,701 and Ser. No. 896,530 each of which is herein incorporated by reference to the extent that the present invention requires an automatically remotely positionable tool support apparatus. However, to generally show the basic tool support apparatus with which the present invention is associated, reference is made to FIG. 1 wherein a portion of a channel head 12 of a nuclear steam generator is shown. The portion shown comprises an outer semispherical shell 16 (having an open man-way 14 for manual access to the inside of the shell) and a horizontally disposed tube sheet 13 having a plurality of vertical openings 15, each containing one end of a heat exchanger tube 17. The channel head is vertically partitioned by a dividing plate 11 into an inlet portion and an outlet portion (each generally being the mirror image of the other and thus only one portion shown) and it is also to be understood that the heat exchanger tubes are generally "U" shaped with one end opening into the inlet portion and the other into the outlet portion.

Apparatus 20 for repairing and replacing the tubes is temporarily (although securely) disposed within each portion below the tube sheet 13. Such apparatus generally comprises a vertical rotatable column 21 having a horizontally extending boom arm 22 subadjacent the tube sheet. A carriage 23 is movably mounted on the arm for horizontal travel therealong as through a worm-screw drive arrangement. The carriage 23 includes a vertically movable platform member 24 supporting thereon a horizontally rotatable plate 25. A tool support arm 26 is attached to the plate through a quick release mechanism 28.

It should be noted that the tool support arm 26 can be rotated 360° in the horizontal plane by the rotatable plate 25 and thus, to retain such freedom of motion, no apparatus can extend downwardly therefrom to interfere with the boom arm 22.

Figure 3:
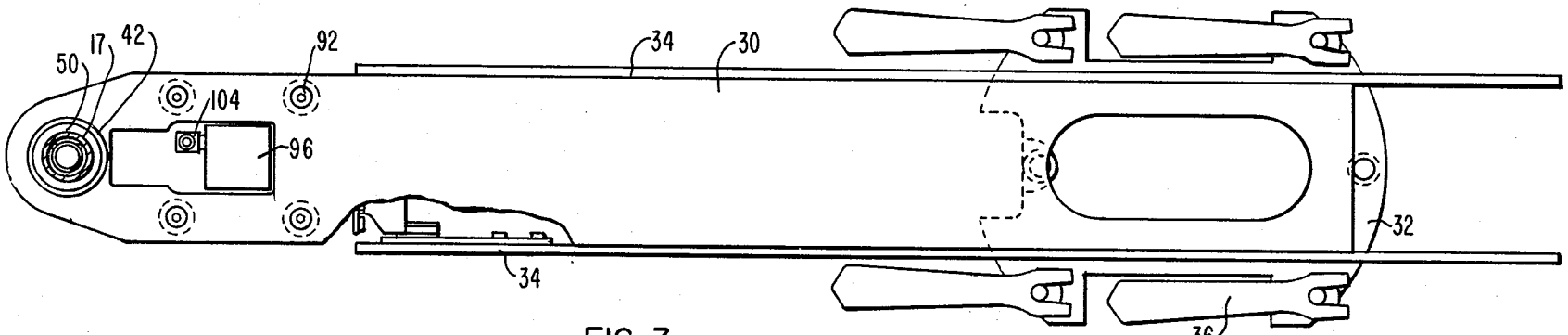
FIG. 3 is a top plan view of the tool and tool support.
Figure 2:
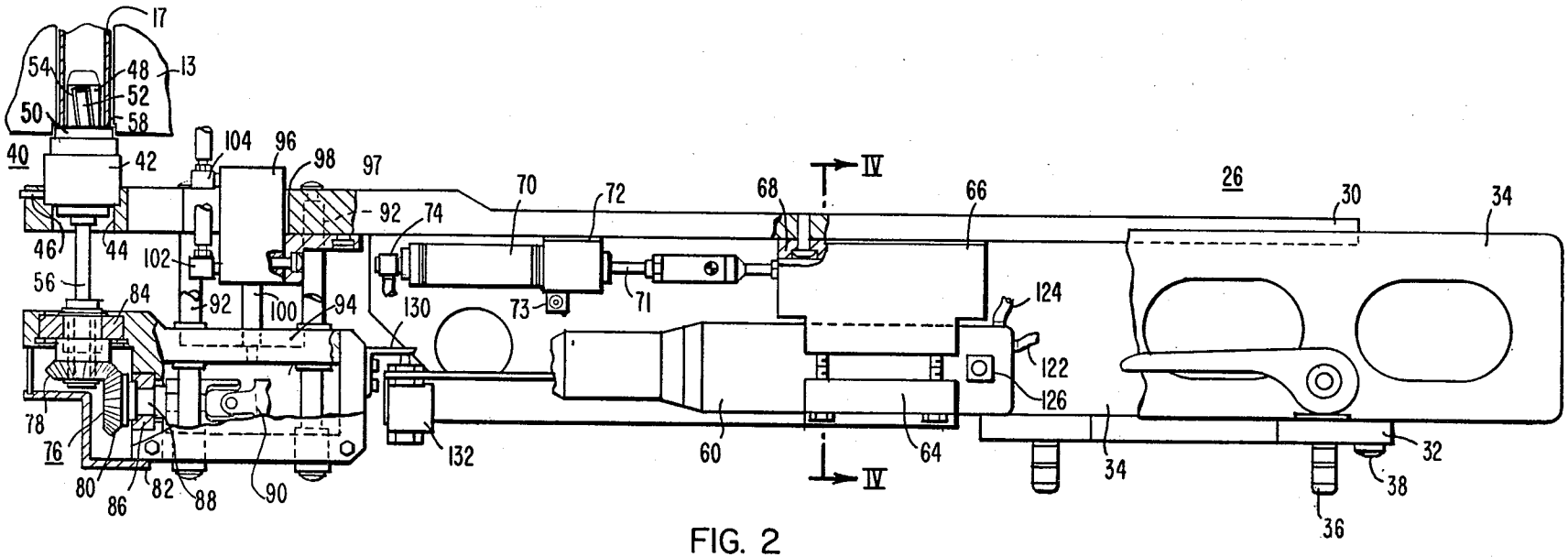
FIG. 2 is a cross sectional side elevational view of the tool and tool support of the present invention.
Figure 4:
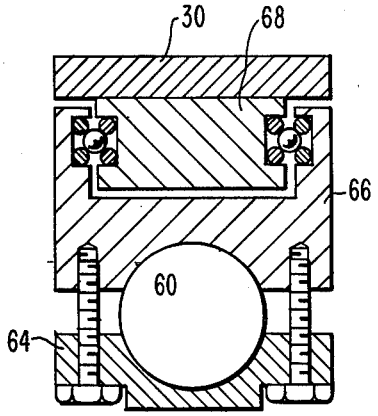
FIG. 4 is a cross sectional view generally along line IV—IV of FIG. 2; and, FIG. 5 is a simplified electrical and pneumatic schematic diagram for the operation of the tool.

Reference is now made to FIGS. 2–4 to show the particular tool and tool support arm for positioning and tack rolling the heat exchanger tube ends within the tube sheet openings according to the present invention.

Thus, the tool support arm 26 comprises an upper, generally planar horizontal support bar 30 and a horizontal mounting base 32 in opposed, spaced relationship generally subadjacent one end of the bar 30. The base 32 and bar 30 are integrally attached by opposed side panels 34 welded to the bar along opposite sides over most of the length thereof, and welded to the top face of base 32. The base 32 has a plurality of Expando Grip pins 36 and guide pins 38 to permit indexed, rapid, secure mounting of the base via receipt of the pins in appropriate apertures in the rotatable plate 25 of the apparatus 20.

The end of the arm 30 opposite the mounting base 32 supports a tack roller tool assembly 40 projecting vertically upwardly therefrom. Such assembly is similar to a commercially available expansion tool assembly (shown in previously identified Airetool Tube Expander Catalog) and comprises a mounting block 42 for stationary indexed receipt in a notched opening 44 in the free end of the bar 30 and held therein by set screw 46. A mandrel cage 48 projects upwardly from a collar member 50 disposed within the mounting block 42 and is sized so as to be received within the tube ends 17. A plurality of cylindrical rollers 52 are retained in slanted openings 54 in the cage 48 and a tapered, vertically disposed drive mandrel 56 extends upwardly through the mandrel cage 48 from a drive arrangement positioned therebelow as will be subsequently described. The collar member 50 has an upper planar face 58 which is sized to engage the end of the tube 17 and abut the downwardly facing tube sheet 13 within a spot face concentric with the tube opening.

A torque controlled reversible air motor 60 is horizontally mounted beneath the support bar 30 and between the side panels 34 just forwardly of the mounting base 32. This motor is also commercially available (and, in fact is essentially the air motor described in the Description of the Prior Art) and is actuated into forward rotation by depression of an internal front clutch through the depression of the nose portion 62 (see FIG. 2A) of the motor. To provide such depression, the motor is mounted for horizontal movement by a motor clamp 64 secured to a slide 66 suspended on a slide mount 68 which in turn is secured to the under surface of the bar 30 (see FIG. 4). An air cylinder 70 is also attached to the under surface of the bar 30 through a mounting plate 72 and has a plunger 71 in aligned engagement with the slide 66. The cylinder 70 has a forward air inlet 73 and a reverse air inlet 74 so that when pressurized air enters through inlet 73 the plunger moves the slide 66 to the left as viewed in FIG. 2 which in turn moves the air motor 60 to the left. Although the motor is thus movable, the subsequently described gears and drive connection are not horizontally movable, and thus this causes the nose 62 to be depressed for forward operation thereof. Air subsequently entering inlet 74 returns the slide and air motor to the initial position shown.

A right angle gear assembly 76 drives the vertical tapered mandrel 56 from the horizontal driving motor 60. The assembly comprises a pair of right angle mounted gears 78, 80 supported within a gear box 82 having an upper bearing 84 supporting the tapered mandrel 56 and a lower bearing 86 supporting a drive shaft 88 of a drive mechanism 90 shown in FIG. 2A interconnecting the motor 60 to the gear 80.

As the tapered mandrel 56 must be raised to cause the rollers 52 to progressively expand the tube 17, the gear assembly 76 is supported for vertical movement. Thus, a plurality of vertical guide posts 92 depend from the undersurface of bar 30 and pass through appropriate sized apertures in a rearwardly extending horizontal member 94 of the gear box 82. An air cylinder 96 is supported by a bracket 97 a central aperture 98 of the bar 30 and has a vertically movable plunger arm 100 extending downwardly and secured to the member 94. The air cylinder 96 has an upward air inlet 102 and a downward air inlet 104 so that pressurized air entering inlet 102 causes the plunger 100 to elevate the gear box 82 and thus the tapered mandrel 56, whereas air entering inlet 104 will return the gear box and the mandrel to their lowermost position as determined by stops or indexing rings on the guide posts 92.

Figure 2A:
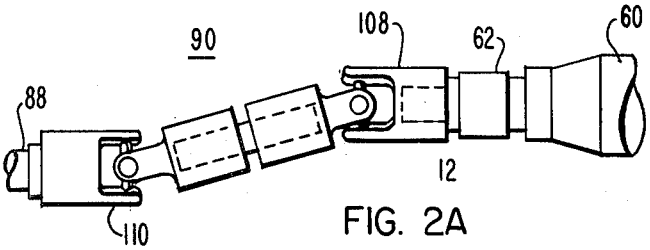
FIG. 2A is a detail view of a portion deleted from FIG. 2.

To accommodate the vertical travel of the gear box 82, the drive mechanisms 90 interconnecting the drive motor 60 to the gear 80 must be generally flexible (although able to resist axial movement so as to cause the motor nose to depress). To this end a pair of universal joints 108, 110 shown in FIG. 2A are interposed between an air motor adapter shaft 112, retained within the nose 62 of the air motor in lieu of a tool shank normally mounted therein, and the drive shaft 88 for gear 80. With this drive mechanism the gear box can be raised and lowered while the motor remains stationary, and permits driving the drive shaft 88 in any of the various elevated positions it assumes.

Figure 5:
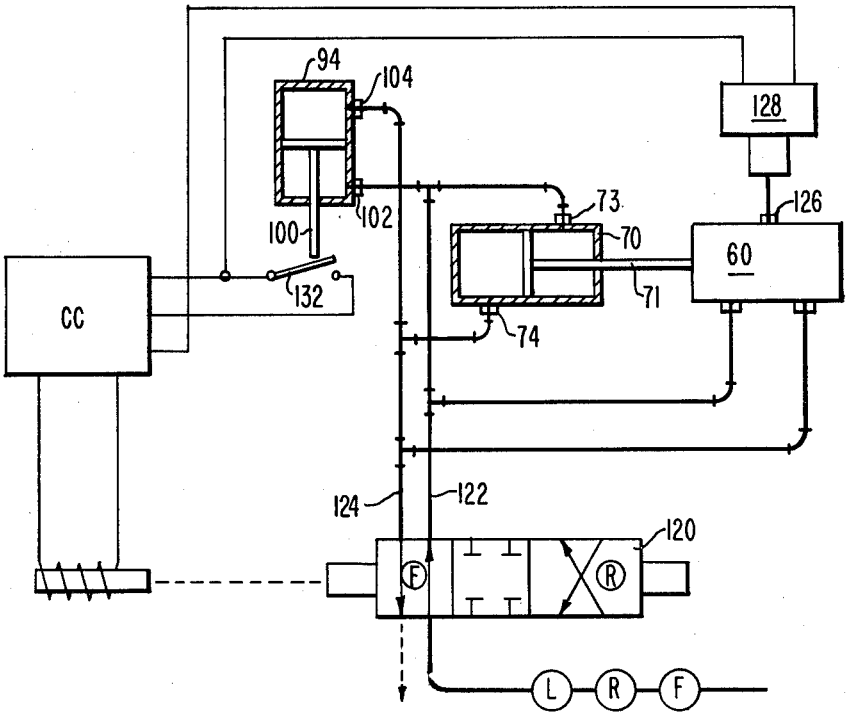

Referring now to FIG. 5, the operation of the tool of the present invention will be described in conjunction with identification of certain switches for the control thereof. It is to be understood that the control for positioning the carriage 23, elevating the platform member 24, and rotating the plate 25 is automatically accomplished through a central control (CC) for placing the tool in the proper position prior to energization of the expansion tool head. Such control includes means, not shown in this invention, for automatically indicating that the tool is in such operating position. Thus, at the beginning of the tube positioning and tack rolling operation, the expanding tool head 40 is automatically axially aligned beneath a tube 17 extending through the tube sheet 13, and then elevated by upward movement of the platform member 24 whereupon the collar member 50 initially engages the tube end and lifts the tube into position flush with the spot face 58 of the tube sheet 13. In such position, the tube is ready to be tack rolled.

At such time, the central control energizes an electrically operated four-way air valve 120 to the forward position F to direct pressurized air through air lines 122 and 124 for operation of the air motor 60 in forward direction. Thus, line 122 provides an air supply and line 124 is the air exhaust. Simultaneous with air being supplied to the air motor 60, pressurized air is also supplied to inlet 73 of the air motor slide cylinder 70 and inlet 102 of the mandrel lift cylinder 96. The air motor slide cylinder 70 thereby moves the motor 60 to the left as viewed in FIG. 2. As the flexible drive 90 is prevented from axial movement, movement of the motor 60 causes the nose 62 thereof to be depressed, as previously explained, to actuate through the internal front clutch, the forward rotation of the motor which in turn drives the mandrel causing the tube 17 to be expanded. The upward movement of the mandrel, as caused by the lift cylinder 96 maintains a continuous upward pressure on the tapered mandrel to force the rollers 52 into the tube wall. Upon completion of the expansion, as determined by a pre-set torque being attained in the air motor 60, the motor "torques out" whereupon forward drive of the motor is terminated and the pressurized air internal to the motor is shunted to a pilot air port 126 causing air pressure in the exhaust line 124 to go to zero and pneumatically activating a "torque out" limit switch 128. Limit switch 128 is connected through the central control to cause energization of the air valve 120 to the reverse R position. Thus, air line 124 becomes pressurized and line 122 becomes the exhaust air. This immediately reverses the drive rotation of the motor 60, forces the motor slide cylinder 70 to its initial position, and lowers the mandrel lift cylinder 96 to free the rollers 52 from the tube wall. Upon the mandrel lift cylinder being lowered, a bracket 130 (see FIG. 2) mounted on the gear box 76 depresses an adjacent stationarily mounted end of cycle limit switch 132. This switch 132, also connected to the central control, signals the control that the mandrel 56 is in its lowermost position and the tool head 40 is available to be lowered via lowering the platform member 24 to be subsequently indexed to a position beneath the next tube to be tack rolled.

Thus an automatically remotely operated tube expansion tool of minimal vertical height is provided for positioning and tack rolling a vertical heat exchanger tube, and the expansion head of the tool and drive therefore are supported on an arm which is able to be rotated 360° in a horizontal plane above but closely adjacent to the boom arm of the support apparatus disposed within the channel head.

I claim:

1. A tool and tool support means for attachment to and operation with remotely disposed and automatically operated apparatus for repairing the tubes and tube sheet of a steam generator, said apparatus having a generally horizontally extending member and means thereon for mounting said tool support means for rotational movement in a plane above and generally parallel to said member and wherein said tool and tool support means do not project below any portion of said member so as to permit uninterrupted rotational positioning of said tool within said plane and wherein said tool support means comprises:

a generally horizontally projecting arm and means for attaching one end of said arm to said mounting means and wherein said arm is configured such that the opposite end thereof is disposed in a plane a predetermined vertical distance above said mounting means;

and wherein said tool comprises:

a tool head mounted on said arm adjacent said opposite end and having an upwardly projecting collar member, a mandrel projecting vertically therethrough and supported therein for rotational and vertical movement;

a drive motor and means for supporting said motor on said arm generally horizontally between said one end and said opposite end thereof;

a flexible drive mechanism for connecting the drive of said horizontal motor to said vertical mandrel, said mechanism comprising a gear drive including a first gear attached to the lower end of said mandrel and engaging a second gear attached to means for connecting said gear to said motor, said first and second gears rotationally mounted in a housing, and means for supporting said housing generally below said opposite end of said arm for guided vertical movement between a lowermost position above the plane of said horizontally extending member of said apparatus and an elevated position for elevating said mandrel of said tool head as required by said tool;

means interconnected between said arm and said housing for raising and lowering said housing in accordance with a predetermined operation sequence and wherein said flexible drive means permits vertical movement of said gears while said motor remains at a constant horizontal plane;

means for moving said motor in said horizontal plane between an at-rest rearward position and activated forward position, in accordance with a predetermined operation sequence; and means for controlling the operation of said motor, said lift means and motor moving means to effect operation of said tool.

2. Structure according to claim 1 wherein said motor, said lift means and said motor moving means are actuated with pressurized air supply thereto through air lines and each of said elements includes at least a first air inlet and a second air inlet such that when said motor, said lift means and said motor moving means receive pressurized air in said first inlets thereof the motor is set for forward rotation, the lift means raises said housing and mandrel and said motor moving means displaces said motor to said activated forward position and the air is exhausted from said elements from said second inlet and when said elements receive pressurized air in said second inlet, the motor reverses, the lift means lowers said housing and said motor moving means displaces said motor to said at-rest rearward position.

3. Structure according to claim 2 wherein said control means includes a valve means movable from a first position for the delivery of pressurized air to said first inlets and a second position for delivery of pressurized air to said second inlets; and, switch means for energizing said valve means from said first position to said second position.

4. Structure according to claim 3 wherein said motor includes means therein for automatically stopping the forward drive thereof open attaining a predetermined torque and an air exhaust port for discharging pressurized air therefrom whenever said automatic means stops said motor and thereby terminating the exhaust from said second inlet and wherein said switch means for energizing said valve means to said second position is responsive to the absence of exhaust air pressure in said second inlet of said motor.

5. Structure according to claim 4 wherein said means for controlling the operation further includes an electric switch mounted on said arm and responsive to said housing being in said lowermost position to indicate said tool and tool support is free of said tube and available for repositioning subadjacent the next tube to be expanded.

* * * * *